US005408494A

United States Patent [19]

Schlienger

[11] Patent Number: 5,408,494

[45] Date of Patent: Apr. 18, 1995

[54] MATERIAL MELTING AND INCINERATING REACTOR WITH IMPROVED COOLING AND ELECTRICAL CONDUCTION

[75] Inventor: Max P. Schlienger, Ukiah, Calif.

[73] Assignee: Retech, Inc., Ukiah, Calif.

[21] Appl. No.: 98,532

[22] Filed: Jul. 28, 1993

[51] Int. Cl.[6] ..... H05B 7/00

[52] U.S. Cl. ..... 373/20; 373/18; 219/121.36; 110/346

[58] Field of Search ..... 373/18, 19, 20; 219/121.36, 121.37, 121.38; 110/246, 247, 345, 346, 341

[56] References Cited

U.S. PATENT DOCUMENTS

| | | | |
|---|---|---|---|
| 3,599,581 | 8/1971 | Schoppe | 110/246 |
| 3,779,182 | 12/1973 | Camacho | 110/234 |
| 4,181,504 | 1/1980 | Camacho | 373/22 |
| 4,326,842 | 4/1982 | Adachi et al. | 219/121.37 |
| 4,432,942 | 2/1984 | Adachi et al. | 219/121.37 |
| 4,582,004 | 4/1986 | Fey et al. | 110/346 |
| 4,615,285 | 10/1986 | Bentell et al. | 110/346 |
| 4,770,109 | 9/1988 | Schlienger | 110/247 |
| 4,912,296 | 3/1990 | Schlienger | 219/121.59 |
| 4,918,282 | 4/1990 | Cheek | 373/20 |
| 5,005,494 | 4/1991 | Schleinger | 110/341 |
| 5,136,137 | 8/1992 | Schlienger | 110/246 |

FOREIGN PATENT DOCUMENTS 1170548 11/1969 United Kingdom .

*Primary Examiner*—Bruce A. Reynolds

*Assistant Examiner*—Tu Hoang

*Attorney, Agent, or Firm*—Townsend and Townsend Khourie and Crew

[57] ABSTRACT

A reactor for incinerating and melting materials such as waste and/or toxic materials has a containment housing inside of which an upright, open-ended drum is rotatably mounted. The drum is lined with refractory, forms a central discharge opening for the removal of incinerated and melted materials, and has an upright, outer wall. Incineration heat is supplied by a plasma torch which is mounted to the containment housing and extends into the drum. A steel throat ring concentric with the discharge opening is connected with the exterior of the drum; e.g. an outer drum wall, by grounding arms which extend non-radially; e.g. tangentially from a periphery of the throat ring to the inside surface of the drum wall, so that electric discharge from the torch to the upwardly oriented surfaces of the throat ring and the grounding arms is possible. The throat ring and the grounding arms are otherwise embedded in insulating refractory material carried by a rotating base plate of the drum which has a radially open, horizontally disposed slit that extends radially from a periphery of the base plate to the vicinity of the discharge opening. Several cooling water nozzles are mounted to the containment housing opposite the slit for directing cooling water jets radially into the slit. The rotation of the drum generates centrifugal forces which aid in the removal of the cooling water from the slit.

33 Claims, 3 Drawing Sheets

MATERIAL MELTING AND INCINERATING REACTOR WITH IMPROVED COOLING AND ELECTRICAL CONDUCTION

This invention relates to improvements in the treatment of a variety of materials, especially waste materials, including those containing combustibles and critical, high performance alloys, by incineration, pyrolysis and/or melting. The invention relates particularly to improvements in the cooling and electrical conduction for such reactors.

BACKGROUND OF THE INVENTION

The disposal of waste materials, especially of toxic waste, with plasma torches is well known and has been performed for some time. In such a process, a plasma torch transfers electrical energy through a stream of ionized gas so that the gas becomes an electrical conductor. With such a torch, very high temperatures of as much as 10,000° C.–15,000° C. can be attained.

In general, there are two types of plasma torches, non-transferred arc torches, in which the electric potential is entirely contained within the torch, and transferred arc torches, in which an arc is struck between the body of the torch on the one side of an electrical field and a point or area spaced therefrom. The present invention is particularly useful with transferred arc torches.

Generally speaking, a plasma torch disposal reactor raises the temperature of waste materials, including toxic waste materials, to such high levels that they chemically break down (pyrolysis). This breakdown can be enhanced by maintaining an atmosphere of the appropriate gas in the incinerator. As a result, the residues are usually harmless gases and solids which can be suitably removed from the incinerator.

In the recent past, significant improvements to such incinerators or reactors were made. The commonly owned U.S. Pat. No. 4,912,296, for example, discloses an advantageous construction for a plasma torch useable with incinerators of the type here under consideration. U.S. Pat. Nos. 4,770,109 and 5,136,137, both by the inventor of this application and also commonly owned, disclose and claim reactors for the incineration and melting of all types of materials, particularly hazardous waste, with which the invention of this application is particularly useful. The disclosure of U.S. Pat. No. 5,136,137 is herewith incorporated herein by reference.

Other patents relating to the field of materials incineration and melting include U.S. Pat. Nos.:

| | |
|---|---|
| 3,599,581 | 4,432,942 |
| 3,779,182 | 4,582,004 |
| 4,181,504 | 4,615,285 |
| 4,326,842 | 4,918,282 |

and British patent 1,170,548.

The reactor disclosed and claimed in the '137 patent incorporated herein by reference uses a rotating, material-receiving drum or chamber into which the hot plasma of a plasma torch is directed. The inner surface profile of the rotating drum is appropriately shaped and constructed so that by varying the speed of rotation of the drum, materials placed into it are spread out over the inner surface of the drum to form a relatively thin layer of such materials which has a large surface area and which can therefore be brought more quickly to the desired high temperatures generated by the plasma torch.

A critical element of such reactors is the rotating drum. It is an open, upright drum that rotates about a vertical axis and has a drum base from which an upright, usually cylindrical outer drum wall extends. The center of the drum forms a discharge opening through which incinerated and melted materials can be gravitationally withdrawn from the drum. The '137 patent discloses in detail how the material in the drum is melted and how the drum is constructed and operated for withdrawing the molten material.

When operating the reactor with a transferred arc-type plasma torch, an electrical conductor must be placed at the bottom of the drum. Current then flows from the torch (which is suspended into the drum from the surrounding containment housing) to the conductor at the bottom of the rotating drum. In the past, a special, electrically conductive throat ring was provided which defined the discharge opening for melted material from the drum and which was appropriately electrically connected (grounded) so that the plasma arc can be generated.

Because of the extreme temperatures inside the drum, the throat ring had to be effectively cooled. In the past, this was done by constructing it of copper and appropriately surrounding its periphery with coolant passages, all as is disclosed in the '137 patent, for example. The necessary cooling not only caused significant heat losses from the reactor to the coolant, it also had the tendency of cooling and eventually freezing molten slag formed by the materials and accumulating at the bottom of the drum. Molten slag is electrically conductive at the high temperatures attained in reactors and, therefore, provides a path for the current flow from the torch to the throat ring and hence to ground. Frozen (solidified) slag, however, becomes an insulator. Thus, the necessary cooling of the throat ring could lead to the interruption of the current path when the slag freezes.

The construction and operation of such reactors, and in particular of the required throat ring, was subject to two antagonistic requirements. The first is to maintain the throat ring sufficiently cooled so that it is not damaged by the high temperature prevailing inside the drum and especially in the vicinity of the discharge arc between the throat ring and the torch. This, however, can lead to slag solidification if the cooling is not carefully controlled and limited. The second requirement is that the cooling of the throat ring should be limited to prevent slag solidification, but the resulting higher temperatures to which the ring is exposed could damage it.

In addition, prior art incinerating and melting furnaces of the type discussed above required substantial amounts of coolant flow. This required relatively intricate and complex coolant flow patterns in the drum, especially in the vicinity of the copper throat ring, and the provision of difficult to seal and maintain, large diameter rotating coolant water seals. Such furnaces, therefore, were not only relatively costly to construct, they required extensive and careful maintenance. Their production costs were further increased by the need to maintain precise concentricities in the mounting and sealing of the drum with respect to the containment housing. All this added to the overall cost of installing and maintaining such reactors and shortened their service life.

SUMMARY OF THE INVENTION

The present invention seeks to overcome some of the shortcomings of prior art material incinerating and melting furnaces. A first aspect of the invention provides an improved construction of the electrical conductors, and in particular of the grounding of the throat ring carried by the rotating drum. A second aspect of the present invention improves and greatly simplifies the need for and the manner in which the rotating drum, and particularly its lower end in the vicinity of the throat ring and the discharge opening of the drum, is cooled. Although both aspects of the present invention are independently useable, they are particularly useful in conjunction because one advantageously affects the other.

Generally speaking, the first aspect of the present invention provides a direct current path from the throat ring surrounding the discharge aperture at the bottom of the rotating drum with the metallic, usually cylindrical outer wall of the drum by means of a plurality of grounding arms extending non-radially from the throat to the outer drum wall. The throat ring and the grounding arms are embedded in high temperature insulating material so that their upwardly facing surfaces are flush with the bottom surface of the drum defined by the insulating refractory material in which they are embedded. The grounding arms are preferably rectangular rods which extend tangentially to a periphery of the throat ring to the inside surface of the outer drum wall to form a secure mechanical and electrical connection between the two.

This electrical connection for the throat ring is advantageous in that it provides a direct current path to the exterior of the drum. The ring and the arms are all embedded in refractory, thereby subjecting them to identical temperatures and temperature gradients. They are further constructed of the same materials, preferably steel, so that their interfaces are not subjected to relative thermal expansions or contractions, which enhances the quality of the electrical interface between them.

Further, the non-radial orientation of the grounding arms permits limited relative radial and rotational movements between the throat ring and the arms, which are embedded in refractory, and the outer wall of the drum. The electric efficiency is enhanced because electric currents resulting from the operation of the plasma torch can flow from the torch not only to the centrally located throat ring, but to the exposed upper surface of the grounding arms as well to provide a more direct current path and better electric conduction.

During operation of the reactor, liquid slag forms on the bottom of the drum and thereby coats the exposed upwardly oriented surfaces of the throat ring and the grounding arms. This does not disrupt operation because in its liquid state the slag is electrically conductive.

Aside from maintaining an electric path from the plasma torch to the throat ring and the grounding arms, the liquid slag also provides a coating which protects these surfaces against corrosion and/or oxidation in the harsh environment of the drum inside during operation of the reactor as materials are melted down, pyrolized and incinerated by the heat of the plasma.

The grounding arms between the throat ring and the outer drum wall are formed at the top of the refractory layer carried by the base plate of the drum and need not be connected to the base plate. Thus, the height of the refractory can be as great as desirable. In this manner, heat transfer from the hot drum interior to the rotating base plate can be minimized by correspondingly increasing the height of the insulation. In a presently preferred embodiment, the thickness of the refractory/insulation layer between the (lower edge of) grounding arms and the base plate is approximately 6 inches.

Nevertheless, constant cooling of the base plate is required. This is done in accordance with the second aspect of the present invention, which provides a relatively thick; e.g. 2-inch thick, base plate constructed of a metal, preferably steel. A ring-shape, radially open slit is formed in the plate and extends from the periphery of the plate to the vicinity of the discharge opening through the bottom of the drum. A cooling medium, preferably a liquid cooling medium such as water, is injected into the slit, in the preferred embodiments with radially oriented nozzles distributed about the periphery of the containment housing wall in alignment with the slit in the base plate so that cooling water jets issuing from the nozzles are pressure forced (by virtue of their discharge velocity) into the slit towards the base thereof.

In use, when the drum rotates about its horizontal axis, cooling water accumulating in the slit is forced out of the slit by the pressure increase generated by the incoming water (from the jets) and by centrifugal forces imparted to the water by the rotating base plate. The coolant water is then collected and, in a preferred embodiment, is recirculated, cooled and reused.

The substitution of the heretofore forced coolant water flow with a free-flowing water injection system greatly simplifies the overall construction and operation of the cooling system. The previous need for large diameter water seals and for complicated coolant water passages through the base plate of the drum is eliminated. In its stead, the present invention provides a simple radially open, ring-shaped slit, preferably formed by two axially spaced, appropriately interconnected disks, and a plurality of stationary water nozzles mounted to the containment housing wall so that their jets are directed towards the base of the slit to effect the desired cooling.

This second aspect of the present invention makes it possible to effectively and inexpensively cool the base plates of high temperature, rotating drum incinerators. The functional separation of the base plate from the grounding of the throat ring, which is required for transferred arc plasma torches, makes it possible to increase the thickness of the refractory insulation layer above the base plate so as to limit the maximum temperatures to which the plate is subjected.

DETAILED DESCRIPTION OF THE PREFERRED EMBODIMENTS

Figure 1:
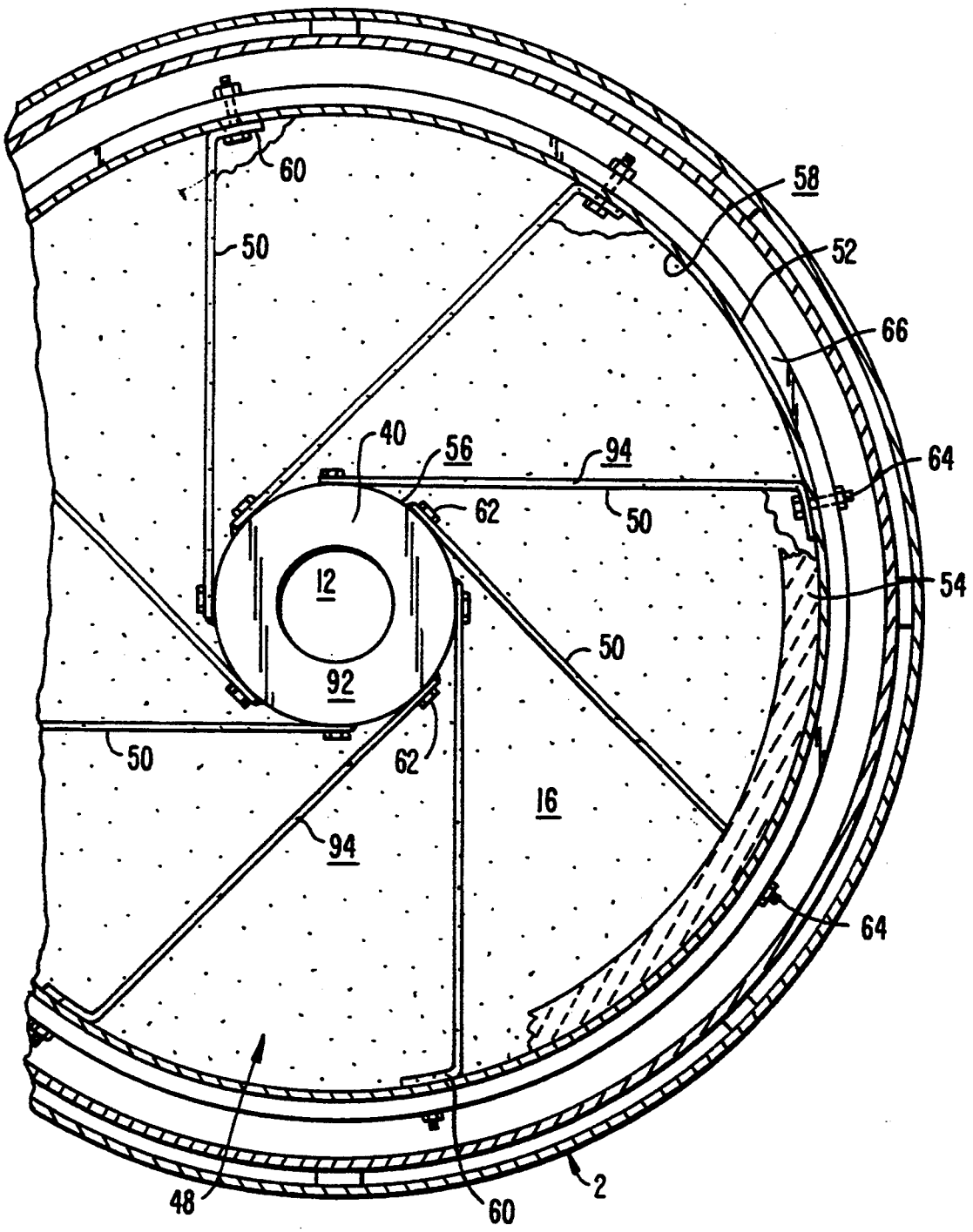
FIG. 1 is a fragmentary plan view, in section, through a material incinerating and melting reactor constructed in accordance with the present invention.

A reactor constructed in accordance with the present invention includes a closed containment housing or vessel 2 having a pipe 4 extending through an opening 6 in the top of the housing for directing materials to be incinerated and/or melted; for example, waste materials, into an interior housing space 8. An upwardly open drum 10 is rotatably mounted on bearings 46 for rotation about a generally vertical axis. The drum includes a lower part or bottom 14 including a central discharge opening 12 through the drum bottom. In a preferred embodiment of the invention, the bottom may have a surface which is downwardly inclined (not shown in the drawings) towards the discharge opening so that the discharge opening forms the lowest point of the drum bottom surface 16.

In one embodiment, the discharge opening is vertically aligned with a water-cooled, rotary electrode 18 mounted for vertical reciprocation in a bearing 20 secured in any suitable manner to a top 22 of the containment vessel 2.

A suitable drive, e.g. a hydraulic actuator 24 is coupled with an upper portion of electrode 18 for moving it vertically in opposing direction. Bearing 20, contained in sliding sleeve, allows the electrode to rotate in one direction about its central axis. To this end, a belt and pulley assembly 26 is coupled to the upper end of electrode 18 and is coupled also to a drive motor (not shown) for rotating the electrode. A rotary water joint 30 is fluidly coupled to the interior of electrode 18 for directing cooling water into its interior. Joint 30 includes a water inlet port 32 and water outlet port 34.

Drum 10 includes an upright, cylindrical outer wall 19 extending from the outer periphery of bottom 14. The side wall extends upwardly, and the lower end of pipe 4 extends partially into the upwardly open drum.

A ball and socket joint 29 rotatably couples a body 27 of a plasma torch 25 to the top 22 of containment vessel 2. Thus, a lower end 31 of the torch can be pivoted with reference to the lower end of electrode 18. Moreover, the electrode has a conductor 33 coupled with the upper end thereof and also coupled to electrical ground 35. A conductor 37 is coupled to the high voltage side of an electric power source 39, the low voltage side of which is coupled to electrical ground 35. An electrical field can therefore be established between electrode 18 and the lower end 31 of the torch so that an arc can be initiated and maintained between the two.

An arc can also be maintained between a throat ring 40 surrounding discharge opening 12 and lower plasma torch end 31 in a manner further described below.

The plasma of torch 25 is of the transferred arc type so that a plasma stream will be generated when the arc is struck, which has a temperature as high as 10,000° C.–15,000° C. The heat from the plasma stream incinerates, causes pyrolysis, and reacts with or melts the materials in drum 10 as the drum is rotated relative to containment vessel 2. As the drum rotates, electrode 18 rotates with it and can be lowered until its tapered lower end contacts the throat ring, thereby closing the discharge opening 12. The electrode can be raised to open the discharge opening 12 as may be necessary for the discharge of products of combustion and melting from the interior of the drum.

In use, hazardous waste or other materials are directed into drum 10 by way of pipe 4. This inflow of waste materials occurs after drum 10 has been rotated and as electrode 18 rotates with it. The electrode typically will plug discharge opening 12 closed so that the waste materials cannot unintentionally gravitate through the hole. A plasma arc is struck between torch 25 and electrode 18, or throat ring 40, causing a plasma stream to be used as the heat source for treating the materials. The torch can be pivoted in any suitable manner about the axis of ball joint 29 to orient the plasma stream as may be required.

The preferably used rotatable electrode 18 has a twofold purpose. First, it provides the termination point for a transferred arc plasma torch 25, especially when nonconducting materials are being melted or incinerated in drum 10. The rotating electrode 18 also serves to close or restrict discharge opening 12. Waste materials fed into the reactor are forced against the inner surface of wall 19 of the drum while the drum is rotating at a speed sufficient to move the incoming material by centrifugal force. To allow the material to flow out of the drum through discharge opening 12, the speed of rotation of the drum is regulated to form an angle of repose of the waste materials, whether solid or liquid, so that they flow along the preferably inclined (not shown) bottom 16 into the discharge opening when it is open.

Rotation of drum 10 can be accomplished in any desired manner, such as with a gear drive (not shown), a chain drive 42 of which only sprocket 44 is shown, and bearings 46 which appropriately support and center the drum relative to the outer containment housing and permit rotation of the drum about a vertical axis.

Figure 2:
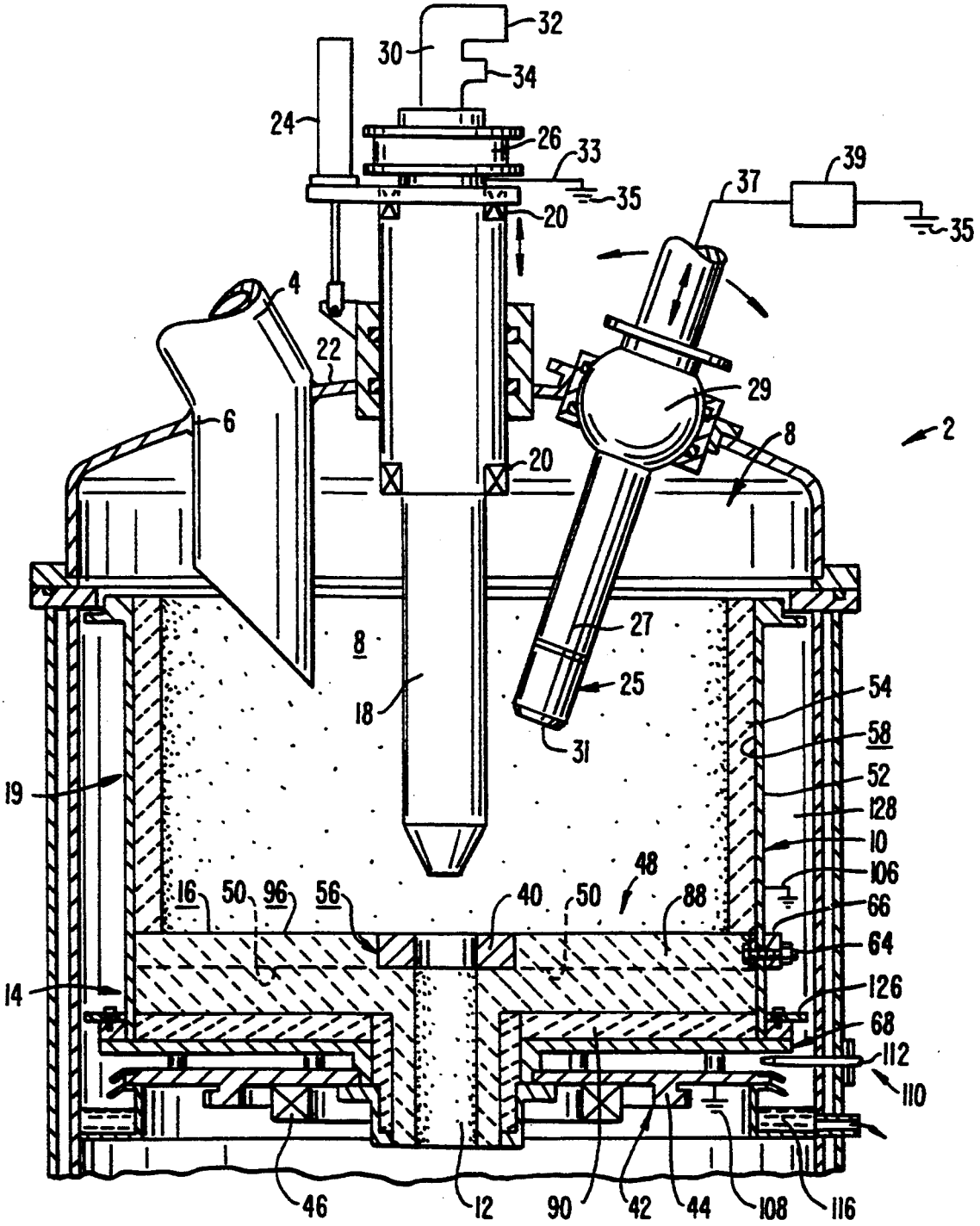
FIG. 2 is a fragmentary, side elevational view, in section, through a reactor constructed in accordance with the present invention.
Figure 3:
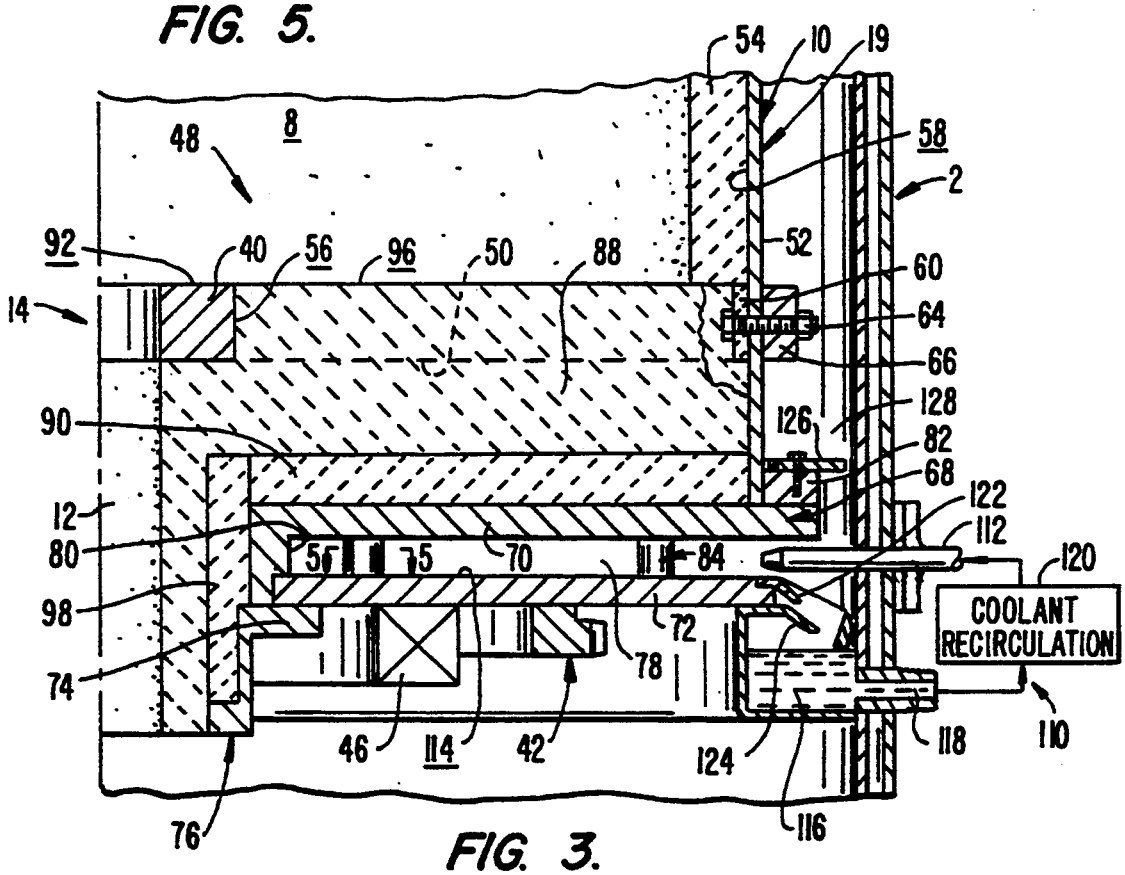
FIG. 3 is an enlarged, fragmentary view, in section, of a lower portion of an upwardly open, upright rotating drum of the present invention inside a containment housing.

Referring to FIGS. 1–3, an electrical grounding system 48 for electrically coupling the termination point of the plasma arc issuing from lower torch end 31 at the drum bottom is formed by throat ring 40 and a plurality of grounding arms 50 which electrically couple the throat ring with the metallic and therefore electrically conductive outside of the drum; e.g. with metal (steel) outer shell 52. A refractory layer 54 is applied to the inside of the outer shell to define the earlier-mentioned outer drum wall 19.

The inner ends of the grounding arms are tangent to a typically cylindrical outer periphery 56 of the throat ring and extend tangentially relative to the throat ring periphery to an inside surface 58 of drum shell 52. The outer end of each grounding arm includes a connecting foot 60 which is bent relative to the remainder of the arm so that it rests substantially flush against the inside surface of the drum shell. Threaded bolts 62 connect the inner end of the grounding arms to the throat ring while bolt-nut combinations 64 secure the connecting foot 60 of the arms to the outer steel shell 52 and a reinforcing ring 66 applied to the exterior of the shell. Welds are further formed at the inner and outer ends of the arms to enhance the connections. As a result, the grounding arms establish firm mechanical and electrical connections between the throat ring and the electrically conductive outer shell 52 of the drum.

The bottom 14 of drum 10 is defined by a base plate 68 which is supported by bearings 46 for rotation about a vertical axis. The base plate is formed of vertically spaced, concentric upper and lower disks 70, 72 carried by and secured to an annular ledge 74 of a hub 76. The disks define between them a ring-shaped, radially outward open slit 78 which terminates in an inner base 80 that is in the vicinity and outwardly of discharge opening 12. A suitable drive, such as chain drive 42, imparts rotation to the base plate when activated. The lower end of outer steel shell 52 of drum wall 19 projects upwardly from the top surface of upper disk 70 and is suitably secured thereto, for example, by welding. A peripheral ring 82 may be provided to lock the lower end of the drum wall in place and assure its concentricity with the base plate.

Figure 5:
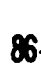
FIG. 5 is a plan view, in section, taken on line 5—5 of FIG. 3.

Spacer blocks 84 are preferably distributed throughout slit 78 to maintain a constant slit width and prevent downward deflection of the upper disk 70 under the weight of the drum and materials placed therein. Preferably, the spacers have an aerodynamically streamlined, tear-shaped cross-section (see FIG. 5) forming a trailing edge 86 facing in a radially outward direction to minimize their fluid flow resistance for purposes further described below.

Placed on top of and carried by upper disk 70 is a thermal insulation layer to protect the base plate from the hot interior of the drum, preventing its overheating, and minimize heat losses through the drum bottom. In a presently preferred embodiment of the invention, the insulation is formed by a layer 88 of high temperature refractory, such as a high temperature aluminae or clay graphite, and a secondary layer of insulating refractory 90, in a presently preferred embodiment made of high quality insulating material such as magnesium oxide insulating bricks. The thickness of the insulation layer (formed by refractory layer 88 and insulating bricks 90) is selected to reduce heat transfer through the drum bottom to the desired level.

On installation, the grounding system 48, and in particular throat ring 40 and grounding arms 50, are embedded in the high temperature refractory layer 88 so that their upwardly facing surfaces 92, 94, respectively, are flush with interior drum bottom surface 96; that is, so that their upper surfaces are not covered by refractory or other insulating materials. As a result, during use of the reactor, electrical current from the plasma torch can flow not only to the throat ring but also directly to the grounding arms along their upwardly facing surfaces 94 to correspondingly enhance electric conduction and the overall electric efficiency of the reactor.

In one embodiment of the invention the high temperature refractory layer 88, in its entirety or at least a top layer thereof forming interior drum bottom surface 96, is constructed of an electrically conductive refractory material capable of withstanding the temperature prevailing in the interior housing space 8. Suitable materials of this type include graphite, clay-graphite mixtures and tin oxide. Such electrically conductive refractory materials facilitate the establishment and maintenance of the plasma arc.

Referring briefly to FIG. 3, in one embodiment of the invention, throat ring 40 forms part of discharge opening 12; that is, its inside hole is flush with a remainder of the hole defining the discharge opening. To provide appropriate insulation, the high temperature refractory insulation layer also forms the discharge opening, with a further secondary insulation layer 98 located radially outwardly thereof and interposed between the inner diameter defined by base plate 68 and the high temperature refractory.

Figure 4:
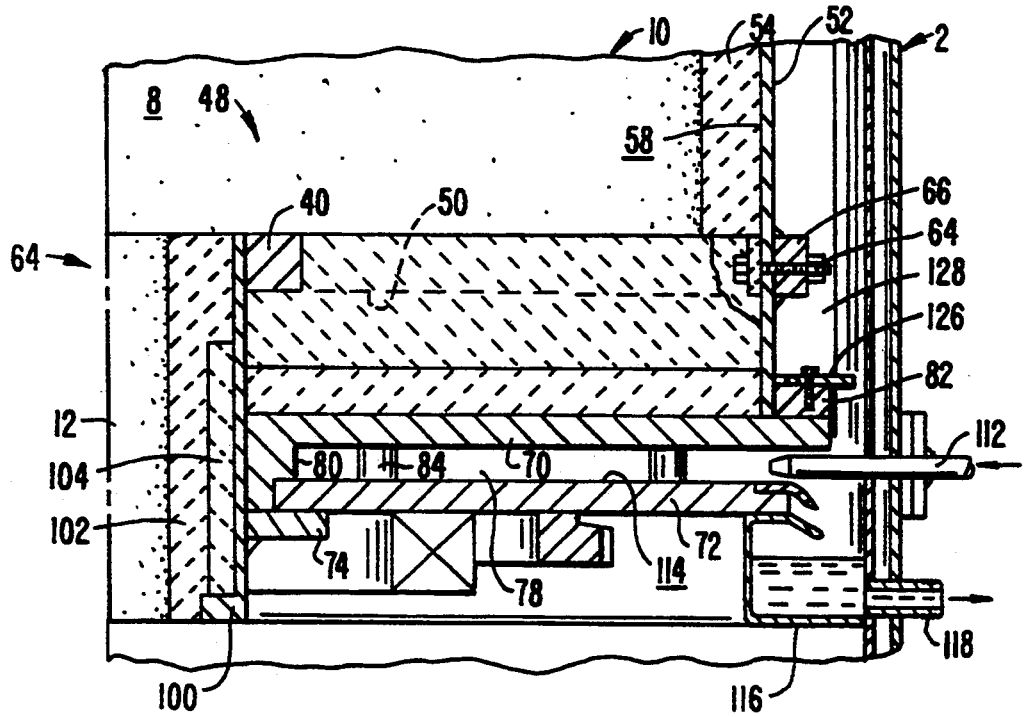
FIG. 4 is a fragmentary, side elevational view, in section, similar to FIG. 3 but illustrates another embodiment of the present invention.

Referring now briefly to FIG. 4, in an alternative embodiment, the inside of throat ring 40 is larger than the diameter of discharge opening 12 through the bottom of the drum. In this embodiment, a hub 100 of the drum extends axially over the full height of the drum bottom and it may, optionally, be secured to the hole defined by the throat ring to thereby form a secondary grounding path from the throat ring to the base plate 68 of the drum. In this embodiment, a high temperature insulation material sleeve 102, made of the same material as high temperature refractory layer 88, for example, is applied to the inside of hub 100. A secondary insulation layer 104 made of magnesium oxide or other appropriate material may be placed over the inside of the hub, especially its lower portion.

In use, when a voltage potential is applied to plasma torch 25, an electric arc discharge will take place between the lower torch end 31 and the rotating electrode 18, when it is lowered to close the discharge opening 12, and/or the upwardly facing surfaces 92, 94 of the throat ring and the grounding arms, since these surfaces are flush with the remainder of the drum bottom surface 96 formed by the insulation layer 88. To effect the current flow, the drum 10 must, of course, be appropriately grounded, as is schematically illustrated at 106 on the periphery of the drum and/or at ground 108 at the base plate of the drum since both are electrically coupled and constructed of steel or similar conductive material.

Referring to FIGS. 1–4, the present invention also provides an effective, relatively low-cost cooling system 110 for cooling the base plate by injecting radial liquid coolant jets, preferably water jets, into the radially open slit 78 in the base plate. For this purpose, the present invention provides a plurality; e.g. four or six (depending on the temperature in the containment vessel and the size of the vessel), of nozzles 112 which are mounted to the containment housing 2, penetrate the housing and direct high pressure water jets (at, depending on the size of the slit, presently preferred pressures of up to about 100 psi) in a radial direction from the open periphery of slit 78 towards its base 80. The streamlined shape of spacers 84 minimizes spray generated when the water jet impacts their radially outwardly facing sides.

The pressure of the water jets is selected so that the jets impinge on the slit base 80. From there, the water is forced radially outwardly for discharge through the open slit periphery by pressure build-up (due to the impact of the water jet on the slit base) as well as by centrifugal forces imparted to it by upper side 114 of lower disk 72 as the disk rotates during operation of the reactor.

Water discharged from the periphery of slit 78 is collected in an annular trough 116 located immediately below drum base plate 68 and recirculated via a trough outlet 118 and a coolant recirculation device 120 (which may include provisions for cooling the water) and reintroduced through nozzles 112. Appropriate flow deflectors 122, 124 may be provided on the periphery of the lower disk 72 and on the top of trough 116 to prevent slashing and help direct coolant into the trough for recirculation.

A skirt 126 is further preferably mounted to the top surface of peripheral ring 82. The skirt is a thin annular member which projects substantially across a gap 128 between the drum 10 and containment vessel 2 to prevent water spray (formed, for example, when the water jet impacts spacers 84) from drifting upwardly into the containment housing to prevent the cooling of the housing interior and undesirable mixing of water or water vapor with the materials being treated in the reactor.

Modifications to the reactor and its various embodiments described above can, of course, be made without departing from the invention. Thus, the coolant need not be water, and instead of recirculating it it can be discharged. Similarly, the manner in which the grounding arms are constructed and secured to the throat ring and the outer steel shell may be varied so long as the grounding arms non-radially extend from the throat ring to the outer drum shell to permit relative movement between the two due to thermal expansions or contractions, for example.

What is claimed is:

1. A reactor for incinerating and melting a material comprising a containment housing including wall means defining a closed interior space;

a drum disposed in the interior space and mounted for rotation about an upright axis, the drum including an electrically conductive throat ring at its center forming a discharge opening through which the incinerated and melted material is discharged from the drum, a peripheral wall substantially concentric with the throat ring, a plurality of electrically conductive support arms extending non-radially from the throat ring to the peripheral wall, means electrically and mechanically securing ends of the support arms to the throat ring and the peripheral wall, and means connected with the throat ring and the support arms defining a bottom surface of the drum for collecting thereon said material during its incineration and melting and for directing the material to the discharge opening;

a plasma torch carried by the housing and extending into the interior space for directing a high temperature plasma into heat exchange relationship with material in the drum for a controlled incineration and melting of the material; and means for electrically coupling the plasma torch and the peripheral drum wall to a source of electric power so that during plasma discharge an electric current flows from the source through the torch, the support arms and the peripheral wall.

2. A reactor according to claim 1 wherein the means defining the bottom surface comprises a layer of high temperature refractory material, the layer and the support arms being arranged so that the bottom surface of the drum is defined by refractory material and the support arms.

3. A reactor according to claim 2 wherein the support arms define a substantially flat, upwardly facing surface, and wherein the bottom surface is defined by the layer and the upwardly facing surface of the support arms.

4. A reactor according to claim 1 wherein the throat ring and the support arms are constructed of metal.

5. A reactor according to claim 4 wherein the throat ring and the support arms are constructed of the same metal.

6. A reactor according to claim 5 wherein the throat ring and the support arms are constructed of steel.

7. A reactor according to claim 6 wherein the means defining the bottom surface comprises a layer of a high temperature refractory, and wherein the throat ring and the support arms are embedded in the layer so that upwardly facing surfaces of the throat ring and the support arm are exposed to permit an electric current flow from the plasma torch to the upwardly facing surfaces of the throat ring and the support arms.

8. A reactor according to claim 4, wherein the means defining the bottom surface comprises a layer of an electrically conductive refractory material.

9. A reactor according to claim 8, wherein the electrically conductive refractory material is selected from the group consisting of graphite, clay graphite and tin oxide.

10. A reactor according to claim 8, wherein the layer and the support arms are arranged so that the bottom surface of the drum is defined by the layer of an electrically conductive refractory material and the support arms.

11. A reactor according to claim 8 wherein the throat ring has a peripheral outer surface, and wherein the support arms are elongated bars extending tangentially relative to the peripheral throat ring outer surface from the throat ring to the peripheral wall.

12. A reactor according to claim 8 wherein first ends of the elongated bars tangentially contact the peripheral outer surface of the throat ring and second ends of the elongated bars in a vicinity of the peripheral wall are non-radially oriented relative to the peripheral wall.

13. A reactor according to claim 1 wherein the means defining the bottom surface includes a metal, horizontally disposed drum support plate and a layer of a refractory material at least partially embedding the support arms therein, and including means disposed between the housing and the drum for cooling the drum support plate comprising a radially open slit formed in the support plate, and means carried by the housing for directing a pressurized stream of a cooling fluid into the slit so that fluid pressure forces the fluid radially inwardly into the slit and centrifugal forces generated when the drum rotates direct cooling fluid injected into the slit radially outwardly and out of the slit.

14. A reactor for incinerating and melting material comprising:

a housing having wall means and forming a containment vessel;

a drum inside the containment vessel, mounted thereto for rotation about an upright axis and including a horizontal, rotatable base plate including a central discharge opening, a peripheral wall extending upwardly from the base plate, an insulating layer on an inside of the peripheral wall and on top of the base plate, a throat ring at least partially embedded in the insulating layer and substantially concentric with the discharge opening for flowing incinerated and melted material through the discharge opening out of the drum, the base plate defining a radially open slit in its periphery extending from the periphery of the base plate towards the discharge opening;

a plasma torch carried by the housing and extending into the drum for directing a high temperature plasma into heat exchange relationship with the material in the drum for its incineration and melting;

means for electrically connecting the throat ring and the plasma torch with an electric power source; and nozzle means for directing a pressurized flow of a cooling medium from between a periphery of the base plate and the wall means of the housing into the radially open slit in the base plate so that during operation, when heat is generated by the plasma torch, the cooling medium is pressure forced into the slit and forced out of the slit by centrifugal force to maintain the base plate cooled.

15. A reactor according to claim 14 wherein the nozzle means is mounted to the wall means of the containment housing.

16. A reactor according to claim 15 wherein the cooling medium is a liquid and wherein the nozzle means comprises a plurality of jets for discharging a relatively high velocity liquid jet into the slit so that the cooling fluid is forced to a vicinity of the discharge opening in the plate.

17. A reactor according to claim 16 wherein the liquid cooling medium comprises water.

18. A reactor according to claim 14 wherein the nozzle means comprises a plurality of jets for discharging the cooling medium, the jets being substantially equally circumferentially spaced and substantially radially oriented with respect to the discharge opening.

19. A reactor according to claim 14 wherein the base plate is constructed of first and second disks, portions of opposing surfaces of the disks being recessed relative to remainders of the opposing disk surfaces so that said portions define the slit, and including spacer blocks disposed between the recessed surface portions of the disks to maintain their spacing, and means securing the disks to each other.

20. A reactor according to claim 19 wherein the nozzle means comprises jets radially oriented with respect to the discharge opening, and wherein the spacer blocks have a general tear-shaped cross-section defining a trailing edge and are oriented between the portions of the opposing surfaces of the disks so that trailing edges of the spacer blocks face radially inward to thereby minimize flow resistance of the spacer blocks in a radially inward direction and minimize liquid spray.

21. A reactor according to claim 16 including an annular space between the wall means of the containment housing and the peripheral wall of the drum and extending upwardly from the slit in the base plate, and including skirt means disposed above the jets and covering at least a substantial portion of the annular space to prevent liquid coolant spray from traveling upwardly through the annular space and into contact with an exterior of the peripheral drum wall.

22. A reactor according to claim 21 wherein the skirt comprises an annular sheet projecting radially outwardly from the drum towards the containment housing wall means.

23. A reactor according to claim 16 including collection means disposed beneath the slit in the base plate for collecting liquid coolant flowing out of the slit, and means for circulating collected liquid coolant from the collection means to the jets.

24. A reactor according to claim 14 wherein the insulating layer includes insulation material disposed between the throat ring and the base plate.

25. A reactor according to claim 24 wherein the throat ring and the base plate are constructed of a metal, and including means forming a metal connection between the throat ring and the base plate.

26. A reactor according to claim 14 wherein the means electrically connecting the throat ring and the plasma torch comprises a plurality of elongated support arms extending tangentially to a periphery of the throat ring from the throat ring to an inside of the peripheral wall, and including means mechanically and electrically connecting the support arms to the throat ring and the peripheral wall.

27. A reactor according to claim 26 wherein the throat ring and the support arms define upwardly facing surfaces, and wherein the throat ring and the support arms are embedded in the insulating layer on the base plate so that the upwardly facing surfaces are free of refractory material to permit electric current flow between the plasma torch and the upwardly facing surfaces.

28. A reactor according to claim 27 wherein an inner surface defined by the throat ring forms part of the discharge opening.

29. A reactor according to claim 27 including a sleeve constructed of an insulating material, disposed about an inside surface of the throat ring, and defining the discharge opening from an interior of the drum past the throat ring, the insulating layer and at least a portion of the base plate.

30. A reactor for incinerating and melting material comprising:

a containment housing defined by wall means and including means for placing the material into an interior of the containment housing;

a drum disposed inside the containment housing, mounted therein for rotation about an upright axis and positioned to receive the material placed into the containment housing interior, the drum including a base plate having a central aperture and a radially open slit extending from a periphery of the base plate towards a vicinity of the aperture, an electrically conductive outer drum wall extending upwardly from the base plate, and a heat insulating refractory layer carried on the base plate and defining a discharge opening for a removal of incinerated and melted material from the drum to an exterior thereof;

a plasma torch carried by the containment housing and extending into the drum for directing a high temperature plasma at the material in the drum to incinerate and melt the material;

contact means for establishing an electric current path through the reactor and adapted to be connected to an electric power source, the contact means including a throat ring concentric with the discharge opening and plurality of grounding arms electrically connecting the throat ring with the outer drum wall, the throat ring and the arms having surfaces exposed to an interior of the drum, the throat ring and the grounding arms being embedded in the refractory layer, the grounding arms being embedded in the refractory layer, the grounding arms extending non-radially from the throat ring to the outer drum wall and being in direct contact with both, whereby a plasma generating discharge takes place between the plasma torch and the surfaces exposed to the interior of the drum; and at least one liquid coolant discharging orifice carried by the containment housing and adapted to a direct liquid coolant jet in a substantially radial direction into the base plate slit and towards the vicinity of the discharge opening so that during incinerating and melting of the material in the drum and rotation of the drum in the containment housing radial forces cause liquid coolant to flow out of the slit.

31. A reactor according to claim 30 including a skirt disposed above the jet means and extending across a gap between the containment housing and the outer drum wall for minimizing liquid coolant droplets from reaching the gap between the outer drum wall and the containment housing wall means.

32. A method of operating a reactor for the incineration and melting of a material, the method comprising the steps of:

providing an upwardly open drum for rotation about an upright axis inside a containment housing;

forming a radially open slit in a portion of the drum disposed beneath a drum interior and positioning a layer of an insulating material between the portion and the drum interior;

placing the material inside the drum;

melting and incinerating the material inside the drum;

removing incinerated and melted material from a bottom of the drum through an open, downwardly oriented discharge opening in the drum bottom;

cooling the portion of the drum by forming at least one jet of a liquid coolant;

directing the liquid coolant jet in a generally radial direction into the slit so that the coolant jet reaches a vicinity of the discharge opening; and flowing liquid coolant out of the slit by subjecting the liquid coolant in the slit to a radially outwardly directed force.

33. A method according to claim 32 wherein the step of subjecting the liquid coolant to a radial force comprises the steps of forming a substantially horizontal surface with the portion of the drum defining a lower end of the slit so that liquid coolant in the slit gravitationally collects on the horizontal surface and the rotation of the drum causes a corresponding rotation of the lower surface and thereby imparts the centrifugal forces to the liquid coolant in the slit.

* * * * *